US006854975B2

(12) United States Patent
Ranzinger

(10) Patent No.: US 6,854,975 B2
(45) Date of Patent: Feb. 15, 2005

(54) ELECTRONIC TRIGGER PULL GAUGE

(75) Inventor: Richard Ranzinger, Meriden, CT (US)

(73) Assignee: Lyman Products Corporation, Middletown, CT (US)

( * ) Notice: Subject to any disclaimer, the term of this patent is extended or adjusted under 35 U.S.C. 154(b) by 169 days.

(21) Appl. No.: 10/202,591

(22) Filed: Jul. 24, 2002

(65) Prior Publication Data

US 2004/0018472 A1 Jan. 29, 2004

(51) Int. Cl.[7] ..... F41G 3/26

(52) U.S. Cl. ..... 434/16; 434/11; 73/167; 33/199 R

(58) Field of Search ..... 434/11, 16, 19, 434/20, 22, 365; 73/167; 345/157, 161, 163; 124/71; 33/199 R; 89/28.05, 135; 341/20

(56) References Cited

U.S. PATENT DOCUMENTS 4,821,422 A * 4/1989 Porter ..... 33/199 R
4,923,402 A * 5/1990 Marshall et al. ..... 434/22
5,316,479 A * 5/1994 Wong et al. ..... 434/11
5,761,954 A * 6/1998 Dvorak ..... 73/167
5,959,613 A * 9/1999 Rosenberg et al. ..... 345/161
6,086,375 A 7/2000 Legros
6,668,700 B1 * 12/2003 Danner et al. ..... 89/135
2003/0221684 A1 * 12/2003 Rice ..... 124/71

* cited by examiner

*Primary Examiner*—Joe H. Cheng
(74) *Attorney, Agent, or Firm*—St. Onge Steward Johnston & Reens LLC

(57) ABSTRACT

A gauge for measuring the force required to discharge a firearm by pulling its trigger includes a housing and a rod including a trigger hook portion at a distal end thereof for engaging the trigger. A load cell is connected to the housing and to a proximal end of the rod such that the load cell generates an electrical signal in response to forces on the rod as the housing is pulled while the trigger hook portion is engaged with the trigger. The magnitude of the electrical signal is proportional to the forces on the rod. A microcontroller receives the electrical signal and calculates a force value based thereon. The microcontroller also continuously monitors the forces on the rod and identifies a trigger pull value of the firearm as being the maximum force on the rod until pulling on the housing is ceased once the trigger of firearm has released.

28 Claims, 3 Drawing Sheets

ELECTRONIC TRIGGER PULL GAUGE

FIELD OF THE INVENTION

The present invention relates generally to a measuring device for use with firearms, and more particularly to an electronic gauge for measuring the force required to discharge a firearm by pulling its trigger.

BACKGROUND OF THE INVENTION

It is often important to be able to measure the force required to discharge a firearm by pulling its trigger (hereinafter referred to as "trigger pull"). Measuring the trigger pull of a firearm is most often necessary in conjunction with adjusting the trigger pull to reach a desired value. For example, one might desire to assure that the trigger pull of a firearm meets the manufacturer's specifications for that particular firearm. In another example, one might desire to adjust all of his or her firearms to have the same trigger pull so that discharge of the firearms during use can be better anticipated.

Various devices for measuring a firearm's trigger pull are known. Such devices have traditionally employed scales, spring gauges, hanging weights or combinations thereof in order to provide an indication of the trigger pull. A widely used trigger pull gauge is formed of an arm which is attached to one end of a spring, with the other end of the spring being attached to a housing. The housing includes an elongated opening in which slides an indicator attached to the end of the spring to which the arm is also attached. An series of metered markings (typically represented in pounds/ounces and/or kilograms/grams) is typically printed on the housing adjacent to the opening in which slides the indicator. The arm includes a hooked end portion which is engaged with the trigger of a cocked, unloaded firearm, and the housing is pulled by the user so that the hooked end portion of the arm pulls the trigger as would the finger of a shooter. As the housing is being pulled the spring elongates, which causes the indicator to slide in the elongated opening. The series of metered markings is scaled such that the distance by which the indicator slides in the opening (which corresponds to the distance by which the spring is elongated) indicates the force which is being exerted on the trigger. The trigger pull can be determined by determining the force which is exerted on the trigger (by viewing the position of the indicator on the meter) at the time the trigger is actuated.

U.S. Pat. No. 6,086,375 to Legros ("the '375 patent") represents an attempt to improve upon the traditional trigger pull gauge, and discloses a trigger pull gauge having a base with a threaded rod rotatably secured thereto. A spring balance is threadably fastened to the threaded rod and is adapted for movement relative to the base when the threaded rod is rotated. The spring balance has a piston rod with a free end formed into a catch for engaging the trigger of a firearm on the base. An upwardly-extending trigger guard retainer is affixed to the base adjacent the free end of the piston rod for retaining the firearm. By rotating the threaded rod, the piston rod is drawn against the firearm trigger such that the force required to discharge the firearm can be read from the spring balance.

These known trigger pull gauges, however, suffer from a number of disadvantages. One such disadvantage is that they require the user to continuously monitor the position of an indicator or slide along a series of metered markings and to determine the position of the indicator or slide at the point where the trigger releases the firing mechanism. This may lead to inaccurate results or require that the test be repeated if the user is not paying extremely close attention. Another disadvantage is that the precision of the system is limited by the users ability to discern slight movements of the indicator or slide along the metered markings. As such, system resolution may be poor. A further disadvantage of these systems is that they are cumbersome in that they require the user to perform a number of tasks simultaneously, including holding the gauge and/or firearm, actuate the gauge by either pulling on it or rotating the threaded rod, and carefully monitoring the position of the indicator or slide along the metered markings. It would be far more desirable if the user did not have to carefully monitor the position of the indicator or slide. Another disadvantage relates to the fact that the user of the system may desire to perform a number of trigger pull measuring tests and then average the results. Using known systems, the user would disadvantageously be required to perform each cumbersome test individually and then to manually perform calculations in order to arrive at an average.

What is desired, therefore, is a gauge for measuring the force required to discharge a firearm by pulling its trigger which is simple to operate and produces accurate results, which produces high-resolution results, which does not require continuous and close monitoring by a user during operation, and which facilitates the operation of averaging the results of several tests.

SUMMARY OF THE INVENTION

Accordingly, it is an object of the present invention to provide a gauge for measuring the force required to discharge a firearm by pulling its trigger which is simple to operate and produces accurate results.

Another object of the present invention is to provide a gauge for measuring the force required to discharge a firearm by pulling its trigger having the above characteristics and which produces high-resolution results.

A further object of the present invention is to provide a gauge for measuring the force required to discharge a firearm by pulling its trigger having the above characteristics and which does not require continuous and close monitoring by a user during operation.

Still another object of the present invention is to provide a gauge for measuring the force required to discharge a firearm by pulling its trigger having the above characteristics and which facilitates the operation of averaging the results of several tests.

These and other objects of the present invention are achieved by provision of a gauge for measuring the force required to discharge a firearm by pulling its trigger having a housing and a rod including a trigger hook portion at a distal end thereof for engaging the trigger of the firearm. A load cell is connected to the housing and to a proximal end of the rod such that the load cell generates an electrical signal in response to forces on the rod as the housing is pulled while the trigger hook portion of the rod is engaged with the trigger of the firearm. The magnitude of the electrical signal is proportional to the forces on the rod. A microcontroller receives the electrical signal and calculates a force value based thereon. The microcontroller also continuously monitors the forces on the rod and identifies a trigger pull value of the firearm as being the maximum force on the rod until pulling on the housing is ceased once the trigger of firearm has released. A display is provided for displaying the trigger pull value of the firearm identified by the microcontroller.

The electrical signal generated by the load cell may comprise a voltage signal, and the microcontroller may be responsive to alternating current signals. In this case, a voltage to frequency converter is preferably connected between the load cell and the microcontroller for converting the voltage signal to an alternating current signal. A preamplifier is also preferably connected between the load cell and the voltage to frequency converter for amplifying and reducing noise in the voltage signal. The display preferably comprises an LCD display.

A memory having calibration data stored thereon is preferably in communication with the microcontroller, and the microcontroller preferably calculates the force value based upon the electrical signal and upon the calibration data. Most preferably, the memory comprises electrically erasable programmable read-only memory.

A trigger roller is preferably mounted on the trigger hook portion of the rod, the trigger roller being substantially cylindrical in shape with a recessed groove around its periphery which allows the trigger roller to be seated on the trigger without easily slipping off during testing. Most preferably the trigger roller is rotatably mounted on the trigger hook portion of the rod so as to reduce friction between the trigger hook portion of the rod and the trigger of the firearm during testing. Preferably, the rod is detachably connected to the load cell.

A memory is preferably in communication with the microcontroller, and the microcontroller preferably stores a plurality of identified trigger pull values in the memory. Most preferably, the microcontroller calculates an average of the plurality of identified trigger pull values stored in the memory upon receipt of an averaging command, and the microcontroller erases the plurality of identified trigger pull values stored in the memory upon receipt of an erase command.

The invention and its particular features and advantages will become more apparent from the following detailed description considered with reference to the accompanying drawings.

DETAILED DESCRIPTION OF AN EMBODIMENT OF THE INVENTION

Figure 1:
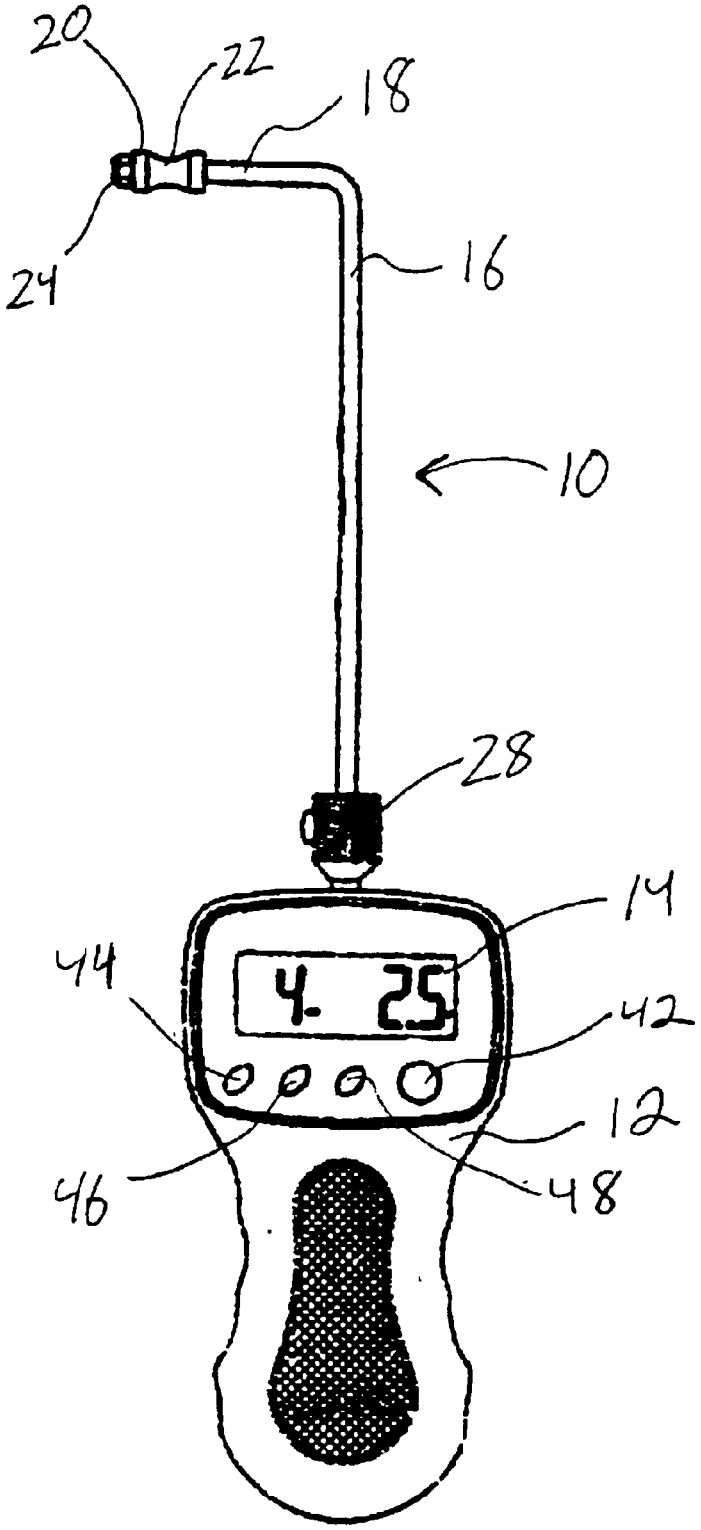
FIG. 1 is a front plan view of a gauge for measuring the force required to discharge a firearm by pulling its trigger in accordance with the present invention.

Referring first FIG. 1 a gauge 10 for measuring the force required to discharge a firearm by pulling its trigger (hereinafter referred to as "trigger pull") in accordance with the present invention is shown. Gauge 10 includes a housing 12 in which the device's electronics (described more fully below) are contained and an LCD display 14 for communicating test results and other information to the user. Gauge 10 also includes a rod 16 extending therefrom which includes a trigger hook portion 18 at a distal end thereof. Trigger hook portion 18 preferably includes a trigger roller 20 rotatably mounted thereon to facilitate engagement with a trigger of a firearm whose trigger pull is to be measured.

Trigger roller 20 is preferably cylindrical in shape with a recessed groove 22 around its periphery which allows trigger roller to be seated on a trigger without easily slipping off during testing. The rotatability of trigger roller 20 reduces friction between trigger hook portion 18 and the trigger of the firearm during testing in order to minimize any potential skewing of test results caused by frictional forces between trigger hook portion 18 and the trigger of the firearm. Trigger roller 20 may be retained on trigger hook portion 18 by a nut 24 which cooperates with a thread on the end of trigger hook portion 18, or by numerous other attachment mechanisms known in the art.

The proximal end of rod 16 is attached through housing 12 to a load cell 26 (i.e., force transducer) as more fully described below. Although rod 16 may be directly connected to load cell 26, it is preferable that rod 16 be connected to load cell 26 through sleeve 28 or the like in order to permit rod 16 to be removable. Such is desirable so as to facilitate storage of gauge 10 when not in use and to reduce the likelihood that load cell 26 and/or rod 16 be damaged by inadvertent force applied to rod 16. Sleeve 28 may comprise a threaded arrangement with a lock nut, a non-threaded arrangement with a set screw, or numerous other attachment mechanisms known to those skilled in the art.

Figure 2:
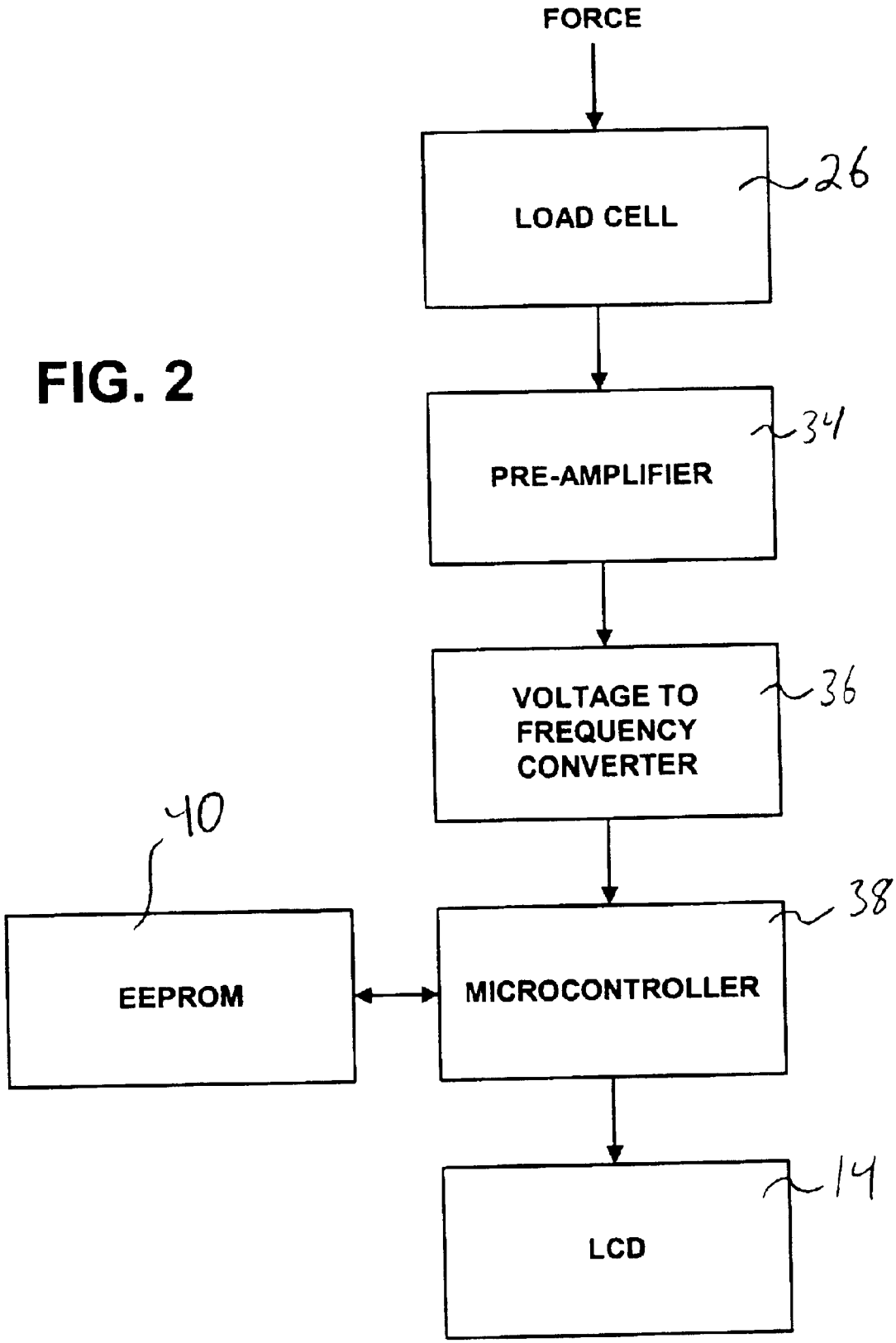
FIG. 2 is a schematic view illustrating operation of the gauge for measuring the force required to discharge a firearm by pulling its trigger of FIG. 1.
Figure 3:
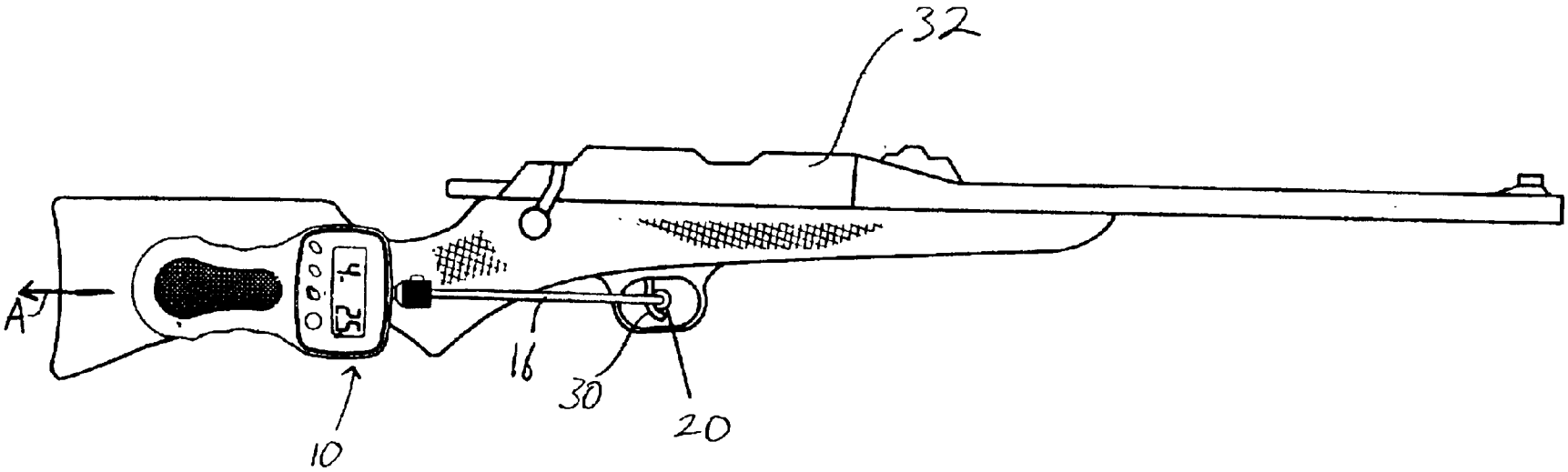
FIG. 3 is front plan view of a gauge for measuring the force required to discharge a firearm by pulling its trigger of FIG. 1 shown being used in conjunction with a firearm.

Referring now to FIGS. 2 and 3, operation of gauge 10 is explained in more detail. Gauge 10 is turned on and trigger roller 20 is positioned against the trigger 30 of a firearm 32 in the position where the finger of the shooter would typically be placed. It should be noted that firearm 32 may comprise substantially any type of firearm, including rifles (shown in FIG. 3), shotguns, handguns, etc. It should also be noted that in order to provide accurate results, firearm 32 should be unloaded and fully cocked with the safety off. Gauge 10 is then pulled, with rod 16 thereof preferably kept parallel with the bore of firearm 32, directly rearward (indicated by arrow A) in a slow constant motion until trigger 30 releases.

As forces are generated on rod 16 as trigger 30 is being pulled, these forces are detected by load cell 26, which generates and transmits to a pre-amplifier 34 a voltage signal, the magnitude of which is dependent upon the magnitude of the forces on rod 16. Pre-amplifier 34 amplifies the voltage signal from load cell 26 and reduces noise and any other unwanted signals and feeds the amplified and cleaned voltage signal to a voltage to frequency converter 36. Voltage to frequency converter 36 converts the voltage signal to an alternating current signal (such as a periodic square wave), the frequency of which is proportional to the input voltage signal received from pre-amplifier 34.

Gauge 10 also includes a microcontroller 38 which is in communication with a memory device, such as an EEPROM (electrically erasable programmable read-only memory) 40. EEPROM 40 has stored thereon calibration data which is the result of a calibration test performed on each gauge 10 against a known weight, preferably at the time gauge 10 is manufactured. Although not strictly necessary, individual calibration data is desirable in order to assure accurate measurements despite any small variances from one load cell to another.

The alternating current signal is fed to microcontroller 38 from voltage to frequency converter 36. Microcontroller 38 then measures the period of this alternating current signal, reads the calibration data stored on EEPROM 40, and uses this information to calculate the force exerted on rod 16. Microcontroller 38 continually monitors the force being applied on rod 16 until the force is removed once the trigger 30 of firearm 32 is released, and the user ceases to pull on gauge 10. At this point, microcontroller 38 displays the maximum force detected for that pull on a display device, such as LCD display 14, as the measured trigger pull.

Microcontroller 38 may also save this measured trigger pull to EEPROM 40 if advanced calculations are desired. For example, it may be desirable to calculate an average trigger pull for two or more trigger pulls to ensure that an accurate trigger pull is measured. In this case, microcontroller 38 could be programmed to perform a simple averaging calculation for two or more measured and saved trigger pulls. In order to perform such calculations, one or more buttons may be provided on gauge 10, as best seen in FIG. 1. For example, a "Start" button 42 could be provided to turn gauge 10 on or off or to indicate that a next trigger pull measurement is to be initiated. An "Average" button 44 may also be provided which when pressed will cause microcontroller 38 to average all trigger pull measurements stored on EEPROM 40 and display the results of such calculations on LCD display 14. A "Clear" button 46 may also be provided which when pressed will cause microcontroller 38 to clear all measurements stored on EEPROM 40 as would be desirable before the trigger pull of another firearm was to be measured or in the case that the user believes one or more of the stored measurements was erroneous and would like that measurement to not be considered as part of an averaging calculation.

Gauge 10 may include additional features. For example, microcontroller 38 may be programmed to automatically turn off after a period of inactivity in order to conserve battery life. In addition, gauge 10 may display measurements in English units, metric units, both English and metric units, or a "Units" button 48 may be provided to cause microcontroller 38 to switch therebetween. Gauge 10 may be powered, for example, by a 9-volt battery. Microcontroller 38 may also be programmed to display an indication on LCD display 14 when the battery is running low.

The present invention, therefore, provides a gauge for measuring the force required to discharge a firearm by pulling its trigger which is simple to operate and produces accurate results, which produces high-resolution results, which does not require continuous and close monitoring by a user during operation, and which facilitates the operation of averaging the results of several tests.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A gauge for measuring the force required to discharge a firearm by pulling its trigger, said gauge comprising:

a hand holdable housing sized and configured to be held by hand or fingers;

a rod including a trigger hook portion at a distal end thereof for engaging the trigger of the firearm;

said housing being pullable by hand when said rod trigger hook portion is engaged with said trigger of said firearm;

a load cell connected to said housing and to a proximal end of said rod such that said load cell generates an electrical signal in response to forces on said rod as said housing is pulled while the trigger hook portion of said rod is engaged with the trigger of the firearm, the magnitude of the electrical signal being proportional to the forces on said rod;

a microcontroller for receiving the electrical signal and for calculating a force value based thereon, said microcontroller continuously monitoring the forces on said rod and identifying a trigger pull value of the firearm as being the maximum force on said rod until pulling on the housing is ceased once the trigger of firearm has released; and a display for displaying the trigger pull value of the firearm identified by said microcontroller.

2. The gauge of claim 1 wherein the electrical signal generated by said load cell comprises a voltage signal, wherein said microcontroller is responsive to alternating current signals, and further comprising a voltage to frequency converter connected between said load cell and said microcontroller for converting the voltage signal to an alternating current signal.

3. The gauge of claim 2 further comprising a preamplifier connected between said load cell and said voltage to frequency converter for amplifying and reducing noise in the voltage signal.

4. The gauge of claim 1 wherein said display comprises an LCD display.

5. The gauge of claim 1 further comprising a memory having calibration data stored thereon in communication with said microcontroller, and wherein said microcontroller calculates the force value based upon the electrical signal and upon the calibration data.

6. The gauge of claim 5 wherein said memory comprises electrically erasable programmable read-only memory.

7. The gauge of claim 1 further comprising a trigger roller mounted on the trigger hook portion of said rod, said trigger roller being substantially cylindrical in shape with a recessed groove around its periphery which allows said trigger roller to be seated on the trigger without easily slipping off during testing.

8. The gauge of claim 7 wherein said trigger roller is rotatably mounted on the trigger hook portion of said rod so as to reduce friction between the trigger hook portion of said rod and the trigger of the firearm during testing.

9. The gauge of claim 1 wherein said rod is detachably connected to said load cell.

10. The gauge of claim 1 further comprising a memory in communication with said microcontroller, and wherein said microcontroller stores a plurality of identified trigger pull values in said memory.

11. The gauge of claim 10 wherein said microcontroller calculates an average of the plurality of identified trigger pull values stored in said memory upon receipt of an averaging command.

12. The gauge of claim 10 wherein said microcontroller erases the plurality of identified trigger pull values stored in said memory upon receipt of an erase command.

13. A gauge for measuring the force required to discharge a firearm by pulling its trigger, said gauge comprising:

a hand holdable housing sized and configured to be held by hand or fingers;

a rod including a trigger hook portion at a distal end thereof for engaging the trigger of the firearm;

said housing being pullable by hand when said rod trigger hook portion is engaged with said trigger of said firearm;

a load cell connected to said housing and to a proximal end of said rod such that said load cell generates a voltage signal in response to forces on said rod as said housing is pulled while the trigger hook portion of said rod is engaged with the trigger of the firearm, the magnitude of the voltage signal being proportional to the forces on said rod;

a preamplifier connected to said load cell for amplifying and reducing noise in the voltage signal;

a voltage to frequency converter connected to said preamplifier for converting the voltage signal to an alternating current signal;

a memory having calibration data stored thereon;

a microcontroller in communication with said memory and connected to said voltage to frequency converter for receiving the alternating current signal and the calibration data and for calculating a force value based thereon, said microcontroller continuously monitoring the forces on said rod and identifying a trigger pull value of the firearm as being the maximum force on said rod until pulling on the housing is ceased once the trigger of firearm has released; and a display for displaying the trigger pull value of the firearm identified by said microcontroller.

14. The gauge of claim 13 wherein said display comprises an LCD display.

15. The gauge of claim 13 wherein said memory comprises electrically erasable programmable read-only memory.

16. The gauge of claim 13 further comprising a trigger roller mounted on the trigger hook portion of said rod, said trigger roller being substantially cylindrical in shape with a recessed groove around its periphery which allows said trigger roller to be seated on the trigger without easily slipping off during testing.

17. The gauge of claim 16 wherein said trigger roller is rotatably mounted on the trigger hook portion of said rod so as to reduce friction between the trigger hook portion of said rod and the trigger of the firearm during testing.

18. The gauge of claim 13 wherein said rod is detachably connected to said load cell.

19. The gauge of claim 13 wherein said microcontroller stores a plurality of identified trigger pull values in said memory.

20. The gauge of claim 19 wherein said microcontroller calculates an average of the plurality of identified trigger pull values stored in said memory upon receipt of an averaging command.

21. The gauge of claim 19 wherein said microcontroller erases the plurality of identified trigger pull values stored in said memory upon receipt of an erase command.

22. A method of measuring the force required to discharge a firearm by pulling its trigger, said method comprising the steps of:

providing a handheld gauge for measuring the force required to discharge a firearm by pulling its trigger, the gauge having a housing and a rod associated with the housing, the rod having a trigger hook portion at a distal end of the rod;

engaging the trigger of the firearm with the trigger hook portion of the rod;

creating forces on the rod by holding said gauge in fingers or hand and pulling on the housing of the gauge;

generating an electrical signal in response to the forces created on the rod, the magnitude of the electrical signal being proportional to the forces on the rod;

calculating a force value based upon the value of the electrical signals;

continuously monitoring the forces on the rod and identifying a trigger pull value of the firearm as being the maximum force on the rod until pulling on the rod is ceased once the trigger of firearm has released; and displaying the identified trigger pull value of the firearm to a user.

23. The method of claim 22 wherein the generated electrical signal comprises a voltage signal, and further comprising the step of, before said calculating step, converting the voltage signal to an alternating current signal.

24. The method of claim 23 further comprising the step of, before said converting step, amplifying and reducing noise in the voltage signal.

25. The method of claim 22 further comprising the step of, before said calculating step, storing calibration data in a memory, and wherein said calculating step comprises the step of calculating a force value based upon the value of the electrical signals and upon the calibration data.

26. The method of claim 22 further comprising the step of storing a plurality of identified trigger pull values in a memory.

27. The method of claim 26 further comprising the step of calculating an average of the plurality of identified trigger pull values stored in memory upon receipt of an averaging command.

28. The method of claim 26 further comprising the step of erasing the plurality of identified trigger pull values stored in memory upon receipt of an erase command.

* * * * *